US006003156A

United States Patent [19]

Anderson

[11] Patent Number: 6,003,156

[45] Date of Patent: Dec. 21, 1999

[54] SAFETY HELMET LOCKOUT SYSTEM

[76] Inventor: Russell Jeffrey Anderson, 5114 Palisade Cir., Fremont, Calif. 92506

[21] Appl. No.: 09/086,792

[22] Filed: May 28, 1998

[51] Int. Cl.[6] ..... A42B 5/08

[52] U.S. Cl. ..... 2/421; 2/410; 2/918; 340/425.5; 340/432

[58] Field of Search ..... 2/410, 417, 418, 2/421, 422, 424, 425, 918, 455, 456, 69; 340/425.5, 426, 427, 573.1, 457.1, 432, 679, 439; 180/271, 287

[56] References Cited

U.S. PATENT DOCUMENTS

| | | | |
|---|---|---|---|
| 3,860,966 | 1/1975 | Brown et al. . | |
| 3,946,441 | 3/1976 | Johnson . | |
| 4,015,294 | 4/1977 | O'Neill | 2/2.1 R |
| 4,130,803 | 12/1978 | Thompson . | |
| 4,134,156 | 1/1979 | Györy . | |
| 4,290,150 | 9/1981 | Guerre-Berthelot . | |
| 4,463,456 | 8/1984 | Hanson . | |
| 4,532,658 | 8/1985 | Zago . | |
| 4,549,541 | 10/1985 | Sundahl . | |
| 4,581,774 | 4/1986 | Chaise | 2/421 |
| 4,612,672 | 9/1986 | Schrack . | |
| 4,719,462 | 1/1988 | Hawkins | 342/20 |
| 4,766,615 | 8/1988 | Morin et al. . | |
| 4,769,857 | 9/1988 | Cianfanelli et al. . | |
| 4,794,652 | 1/1989 | Piech von Planta et al. . | |
| 4,884,302 | 12/1989 | Foehl . | |
| 4,982,452 | 1/1991 | Chaise | 2/421 |
| 5,010,598 | 4/1991 | Flynn et al. . | |
| 5,084,918 | 2/1992 | Breining et al. . | |
| 5,237,707 | 8/1993 | Lowrie . | |
| 5,327,588 | 7/1994 | Garneau . | |
| 5,448,780 | 9/1995 | Gath . | |
| 5,561,866 | 10/1996 | Ross . | |
| 5,666,700 | 9/1997 | Anscher et al. | 2/421 |
| 5,713,804 | 2/1998 | Socci et al. | 473/422 |
| 5,757,085 | 5/1998 | Fischer et al. | 307/10.5 |
| 5,898,365 | 4/1999 | Niederlein | 340/425.5 |
| 5,900,806 | 5/1999 | Issa et al. | 340/426 |

FOREIGN PATENT DOCUMENTS

| | | |
|---|---|---|
| 72767 | 8/1983 | European Pat. Off. . |

*Primary Examiner*—Gloria M. Hale
*Assistant Examiner*—Tejash Patel
*Attorney, Agent, or Firm*—Flehr Hohbach Test Albritton & Herbert

[57] ABSTRACT

The Safety Helmet Lockout System comprised of a safety helmet with a uniqely keyed system contained within its cranial webbing and chinstrap that has the ability to sense when said helmet is securely strapped upon the wearers head. The chinstrap contains a locking buckle which releases a uniqely keyed enabling key and/or a signal upon sensing that said safety helmet is securely strapped upon the wearers head. Several means of sensing are possible, but the preferred embodiment employs physio sensors located within the cranial webbing and chinstrap of said safety helmet. The locking buckle which is located on the chinstrap, releases said enabling key or signal after recieving signals from all the physio sensors, and sensing tension in the chinstrap. The released enabling key, or emitted signal, can then be used to access vehicles, sporting goods, industrial equipment, tools, passage locks, and the like. The access locks can range from simple ignition locks and passage locks, to retracting pin or keyed brake systems, keyed clutch systems, and specialty lockout systems for certain applications (such as, but not limited to, skiis, snowboards, and snowmobiles).

10 Claims, 3 Drawing Sheets

SAFETY HELMET LOCKOUT SYSTEM

Accordingly, several objects and advantages of my invention are;

One object of the invention is to provide a Safety Helmet Lockout System that provides significant assurance that the operator of equipment, such as but not limited to, bicycles, skiis, skateboards, rollerblades, snowboards, tobogans, motorcycles, watercraft, snowmobiles, go carts, sleds, forklifts, cranes, hoists, military vehicles, aircraft, amusement rides, etc. has their safety helmet on before beginning operation of, or having access to, said vehicles or equipment.

Another object of the invention is to provide significant assurance that said safety helmet is securely strapped to the operators head, which gives increased assurance that said helmet will remain on the operators head where it can provide maximum protection in case of an accident.

Another object of the invention is to provide a Safety Helmet Lockout System that will reduce mortality rates and serious head injuries due to traffic, sporting, and industrial accidents.

Yet another object of this invention is to provide a Safety Helmet Lockout System that will provide increased theft protection due to its ability to render unattended vehicles and equipment relatively unusable or immobile without said safety helmets and/or their lockout keys.

Yet another object of this invention is to provide a Safety Helmet Lockout System that will result in lower accident insurance rates.

Yet another object of this invention is to provide a Safety Helmet Lockout System that will result in lower liability insurance rates.

Yet another object of this invention is to provide a Safety Helmet Lockout System that will result in lower liability insurance rates.

Yet another object of this invention is to provide a Safety Helmet Lockout System that will result in reduced burdens on law enforcement personnel and court systems that are being asked to enforce an ever increasing set of safety helmet use laws.

Yet another object of the invention is to provide a Safety Helmet Lockout System that will provide greater peace of mind and reduced liability to parents and guardians when their children embark on recreational activities.

Yet another object of the invention is to provide a Safety Helmet Lockout System that will provide greater peace of mind and reduced overhead costs to the owners and operators of sporting facilities such as skate parks, ski resorts, bicycle rentals, motocross tracks, go cart tracks, amusement parks, etc.

Yet another object of the invention is to provide a Safety Helmet Lockout System that will provide greater peace of mind and reduced liabilities to the owners and operators of construction sites, mills, foundries, mining operations, and other industrial sites and dangerous locations.

Yet another object of the invention is to provide a Safety Helmet Lockout System that will provide greater protection to personnel and visitors who are about to try to enter any dangerous areas.

Yet another object of the invention is to provide a Safety Helmet Lockout System that can provide greater protection to operators of military equipment (tanks, trucks, jeeps, aircraft, etc.) by ensuring that they have their protective helmets firmly strapped upon their heads before operating said equipment.

Further objects and advantages of my invention will become apparant from a consideration of the drawings and ensuing descriptions.

Safety Helmet Lockout System

Figure 1B:
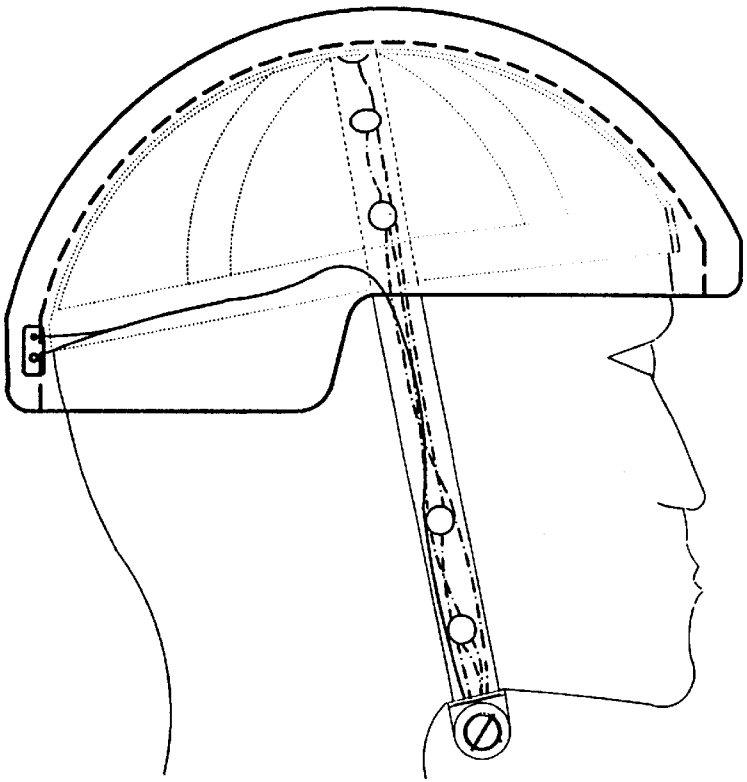
FIG. 1*b* shows the same profile view with a typical wearers cranial outline.

| Reference Numerals: Item # | Item Description | Shown In FIGS. |
|---|---|---|
| 10 | Safety Helmet (one iteration of) | 1, 2 |
| 11 | Chin Strap | 1, 2 |
| 12 | Physio Sensors (can also employ sensors for light, magnetism, pressure, proximity, temperature, etc.) | 1, 2 |
| 13 | Cranial Webbing | 1, 2 |
| 14 | Locking Buckle | 1, 2 |
| 15 | Enabling Key | 1, 2, 3a |
| 16 | Physio Signal Wires | 1, 2 |
| 17 | Battery | 1, 2 |
| 18 | Power Supply Wire | 1, 2 |
| 19 | Tension Sensor | 2 |
| 20 | Retaining Pins or Tumblers | 2 |
| 30 | Rotational Lockout System (Retracting Pin type for rotational lockout) | 3a, 3b |
| 31 | Engaging Pin | 3a |
| 32 | Advancing Spring | 3a |
| 33 | Retracting Spring | 3a |

SUMMARY OF THE INVENTION

The inventive Safety Helmet Lockout System is a system that provides a means of locking out or prohibiting the use of vehicles, sporting goods, access passageways, and various other equipment, etc., if the operator does not have a safety helmet strapped to their head. Furthermore, the Safety Helmet Lockout System has the additional advantages in that it is usable in combination with a variety of lockout systems including but not limited to a) Retracting Pin, Clutch, or Brake types of Lockout Systems which prohibit rotational movement, or b) Ignition Lockout Systems which prohibit the ignition of drive motors and engines, or c) Simple Keylock Lockout Systems for prohibiting access to various equipment, tools, passageways, or the like, or any number of specialty Lockout Systems such as that for snow skiis and snowboards which engages and disengages the two pronged brakes which were originally designed to stop said skiis and snowboards when the skiers boots came out of their bindings.

DETAILED STATIC DESCRIPTION OF THE INVENTION

Figure 1A:
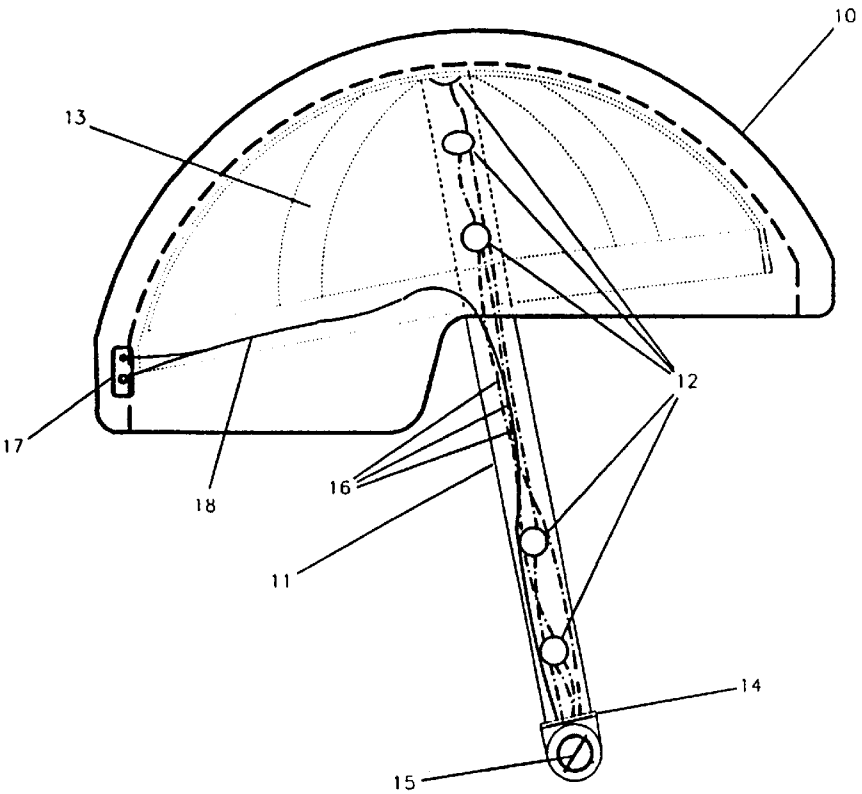
FIG. 1*a* shows a profile view of one exemplary embodiment of the inventive Safety Helmet and Chin Strap, along with the Physio Sensors, Cranial Webbing, Locking Buckle, and Enabling Key for one variation of the invention. A battery is also shown which may be desirable to boost the signals from said Physio Sensors to said Locking Buckle in order to release the retaining tumblers or pins within said Locking Buckle.

FIG. 1*a* shows a profile view of the Safety Helmet 10. The Cranial Webbing 13 and Chinstrap 11 are affixed to the Safety Helmet 10. Physiosensors 12 are integral to the Chinstrap 11, and they are exposed on the inner side of the Chinstrap 11. Physiosensor Wires 16 are sandwiched between the two layers of the Chinstrap 11, connecting the Physiosensors 12 to the electromagnetic switch within the Locking Buckle 14. A Battery 17 is housed in the rear of the Safety Helmet 10, and the Power Supply Wire 18 runs from the Battery 17 to the electromagnetic switch within the Locking Buckle 14. FIG. 1*a* also shows the recieving side of the Locking Buckle 14, with an Enabling Key 15 engaged in the Locking Buckle 14. One end of the Chinstrap 11 is permanently affixed to the Locking Buckle 14. The other end of the Chinstrap 11 threads through the Locking Buckle 14.

Figure 2:
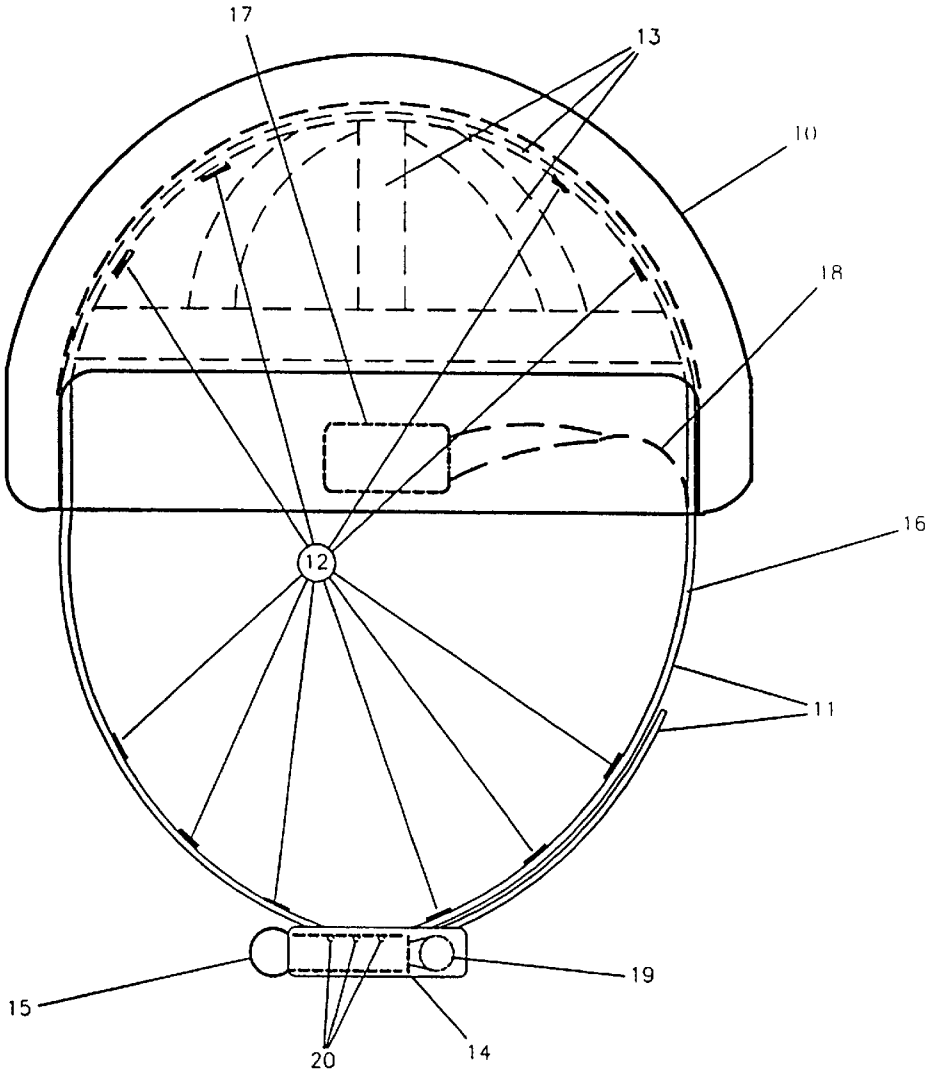
FIG. 2 shows a frontal view of one exemplary embodiment of the Safety Helmet and Chin Strap, along with the Physio Sensors, Cranial Webbing, Locking Buckle with an engaged Enabling Key for one variation of the invention. A battery is also shown which may be desirable to boost the signal to said Locking Buckle in order to release the retaining tumblers or pins within said Locking Buckle.

FIG. 2 shows a frontal view of the Safety Helmet 10. The Locking Buckle 14 is shown with the Tension Sensor 19 inside, and the Chinstrap 11 running through the Locking Buckle 14 with one end alongside the Tension Sensor 19. The Retaining Pins or Tumblers 20 are engaging the Enabling Key 15 within the Locking Buckle 14.

Figure 3A:
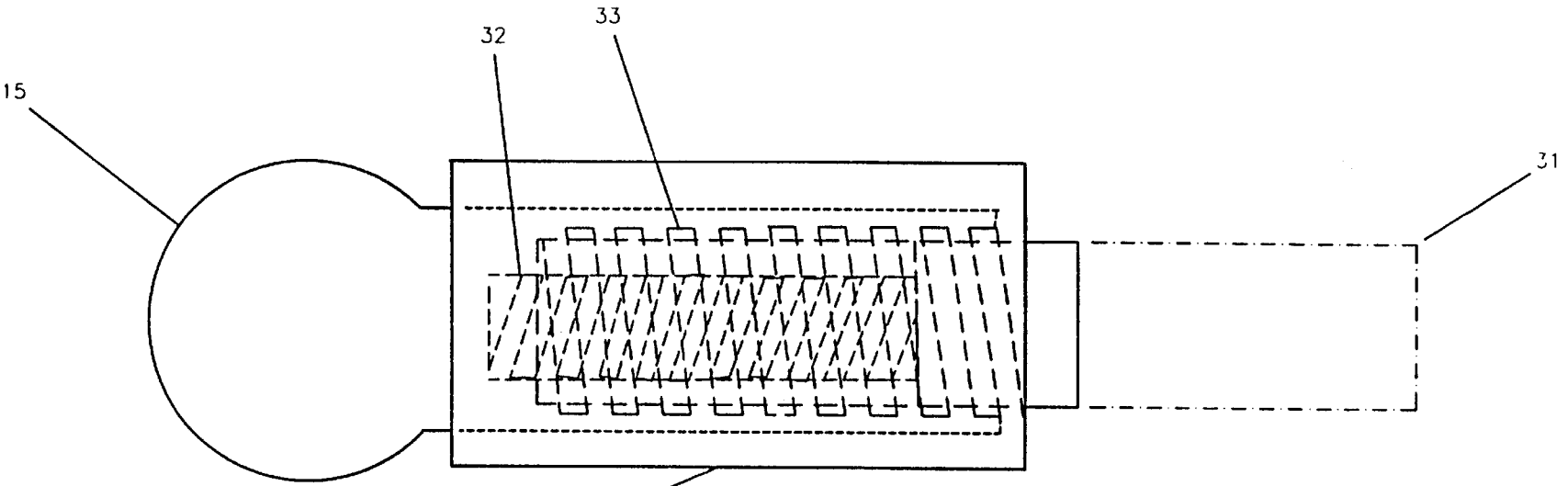
FIG. 3*a* shows an enlarged view of one iteration of the Rotational Lockout Mechanism, that of a Retracting Pin type, with an engaged Enabling Key.
Figure 3B:
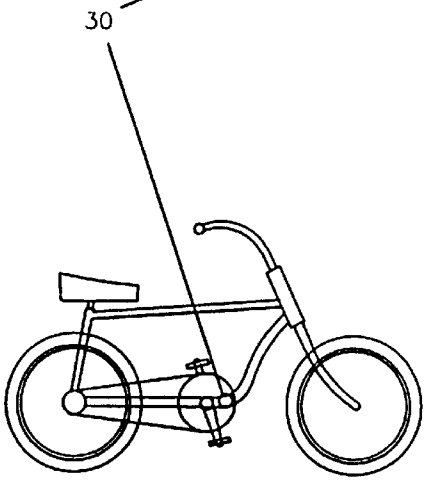
FIG. 3*b* shows said iteration of said Rotational Lockout Mechanism in but one of a plurality of possible configurations, that of a Retracting Pin configuration mounted to a bicycle frame for engagement of the sprocket.

FIG. 3*a* shows a profile view of the Rotational Lockout System 30. The Enabling Key 15 engages the recieving end of the Rotational Lockout System 30. Advancing Spring 32 is inside of the Rotational Lockout System 30 with one end fixed, and the other end against the Engaging Pin 31. The Retracting Spring 33 is inside of the Rotational Lockout System 30, with one end fixed (to the opposite side as the Advancing Spring 32), and the other end against a flanged end of the Engaging Pin 31.

OPERATION OF THE INVENTION

Vehicle or equipment operator, or accessee, places Safety Helmet 10 on head, as shown in FIG. 1*b*. The Enabling Key 15 is always restrained within Locking Buckle 14, located at the end of Chin Strap 11, until said Safety Helmet 10 has been securely strapped upon wearers head. Once Safety Helmet 10 is atop wearers head with Chin Strap 11 securely fastened, then Tension Sensor 15 located within Locking Buckle 14 will sense tension within Chin Strap 11. With Safety Helmet strapped securely upon wearers head, then all of the Physio Sensors 12 will be in contact with wearers head, and cheeks. Once all of Physio Sensors 12 are sending signals via the Physio Signal Wires 16 to Locking Buckle 14, and Tension Sensor 15 senses tension in Chin Strap 11, then Restraining Pins or Tumblers 20 within Locking Buckle 14 will retract, allowing said Enabling Key 15 to be rotated and removed from Locking Buckle 14. The physio signals are amplified using power from the Battery 17, and then sent through electromagnetic relays to facilitate the retraction of the Restraining Pins or Tumblers 20. The Physio Sensors 12 can be one of a plurality of types, specifically but not limited to, "Photoelectric Pulse Monitors" developed by Robert Page (reference expired Patent 3841314), or alternatively "Infrared emitting diodes and infrared ray recieving phototransistors", developed and marketed by a Japanese consortium (reference expired Patent 4425921), or alternatively those used and marketed by Lifecycle corporation as "Stairmaster" and "Eliptical Cycle" pulse monitoring accessories.

Removal of Enabling Key 15 from Locking Buckle 14 will lock the Locking Buckle 14 and Chin Strap 11 in place, until Enabling Key 15 is reinserted into the Locking Buckle 14 and rotated.

Once the Enabling Key 15 has been removed from the Locking Buckle 14, the Enabling Key 15 can be used to unlock the corresponding Lockout System 30 (in this case a Rotational Lockout System).

The Rotational Lockout System 30 is mounted to the vehicle frame and has its Engaging Pin 31 fully extended by employment of the Advancing Spring 32. The Engaging Pin 31, prohibits any engaged rotational drive component (ie: wheel, sprocket, pulley, etc.) from turning. Once the Enabling Key 15 is inserted into the recieving slot of the Rotational Lockout System 30 and rotated, the Engaging Pin 31 is retracted away from the engaged rotational drive component by the Retracting Spring 33, allowing the rotational drive component to rotate freely (thus allowing vehicle operation). The Enabling Key 15 will be retained by pins or tumblers within the Rotational Lockout System 30, until it is rotated and removed. Such rotation and removal of the Enabling Key 15 will re-extend the Engaging Pin 31 by releasing the Advancing Spring 32. This re extension of the Engaging Pin 31, will prohibit the rotation and subsequent operation of the rotational drive component.

The removed Enabling Key 15 can now be used to unlock the Locking Buckle 14 by reinsertion of the Enabling Key 15 into the Locking Buckle 14 and rotating. Enabling Key 15 will once again be retained within the Locking Buckle 14 until it is removed during the Safety Helmets 10 next utilization.

The Enabling Key 15 will be uniquely keyed for each Safety Helmet 10, and its corresponding Lockout System. That unique keying will prevent the use one systems key on the Lockout Systems of other parties.

DESCRIPTION AND OPERATION OF INVENTION —ALTERNATIVE EMBODIMENTS

A second embodiment of the invention is described relative to a Safety Helmet which senses the secure strapping upon the wearers head in the same manner as described in the previous section. Instead of releasing an Enabling Key, this alternate embodiment emits an electrical, audio, optical, or electromagnetic signal to its corresponding lockout device(s).

A third embodiment of the invention is described relative to an Ignition Lockout System. The Safety Helmet portion of the Ignition Lockout System will be physically and operationally the same as the Rotational Lockout system described in the previous section. Only the lockout portion differs. The Ignition Lockout System will require the Enabling Key 15 to activate an ignition system. Said Ignition type of Lockout System can be used for any vehicle, equipment, or apparatus which employs a drive motor or engine.

Another alternative embodiment of the invention is described relative alternative brake type lockout systems. Once again, the operation of the Safety Helmet portion of the Invention for other Brake Lockout Systems will be the same as that described above for the Rotational Lockout System. Only the method of operation and configuration for the actual Lockout System restraints will differ in these other lockout systems. The Brake type Lockout System will utilize one of many forms of braking system (ie: clamp, or cable, or clutch type) to prohibit operation of a plurality of vehicles, or rides, or equipment.

Still another alternative embodiment is a Specialty Brake type of Lockout System for use with non rotational applications, such as those used with skiis, snowboards, or sleds. Yet again, the Safety Helmet portion of the Specialty Brake Lockout System will be physically and operationally the same as that described for the Rotational Lockout system. Only the lockout portion differs. The Specialty Brake Lockout System requires the Enabling Key 15 to engage and disengage the two prong or paddle type braking systems that are already in use for braking skiis after the skiers boots come out of the ski bindings. The Enabling Key 15 will be inserted into a reciever behind the ski bindings to retract the pronged brakes, thus enabling the use of the skiis, or snowboard, or sled, or the like.

CONCLUSION, RAMIFICATIONS, AND SCOPE

Thus, the reader will see that the Safety Helmet Lockout System provides significant assurance that the operator of potentially any vehicle, sporting equipment, construction or industrial equipment, etc. has a safety helmet securely fastened atop their head before they can begin operation of, or gain access to, said vehicle or equipment.

While my above description contains many specifications, these should not be construed as limitations on the scope of the invention, but rather as an exemplification of one preferred embodiment thereof. Many other variations are possible. For example, other means of sensing the helmet bearers engagement of said helmet are possible (ie: light sensors, pressure sensors, proximity sensors, sound waves, magnetic sensors, etc.).

A photoelectric, electromagnetic, or sonic signal may be used to signal the lockout systems instead of an enabling key.

There are also many alternate means of lockout mechanisms. In addition to the retracting pin lockout mechanism, there are brake type lockout mechanisms, clutch type lockout mechanisms, ignition type lockout mechanisms, padlock type lockout systems, and dozens of other specialized lockout systems for specific applications.

There are also almost unlimited applications for the use of Safety Helmet Lockout systems. While many of the more obvious applications (bicycles, skateboards, snowboards, skiis, rollerblades, snowmobiles, sleds, motorcycles, watercraft, go carts, forklifts, cranes, hoists, military vehicles, aircraft, amusement rides, industrial equipment, tools, mines, foundries, factories, and other dangerous access areas) have been discussed in previous sections, the potential applications should by no means be limited to those afforementioned.

The verification and lockout techniques specified above can also be utilized to ensure that other protective apparatus (face shields, protective suits, body armor, etc.) are in place before operating or accessing vehicles, industrial equipment, sporting goods, radioactive areas, etc. The use of said techniques are not limited to safety helmets.

In addition to being provided as a built in feature of new vehicles, equipment, access apparatus, etc., the Safety Helmet Lockout Systems can be easily retrofitted to existing vehicles, equipment, construction and industrial apparatus, etc.

I claim:

1. An equipment use-prevention lockout system comprising:

an item of equipment rendered in a non-operational condition until enabled to an operational condition by an enabling means;

a protective apparatus separate from said item of equipment intended to be worn by a user during operation of said item of equipment and having a sensor system for determining that said user has properly secured said protective apparatus to said user; and said sensor system communicating with said enabling means to permit said enabling means to alter the condition of said equipment from said non-operational condition to said operational condition only when said sensor system has determined that said user has properly secured said protective apparatus to said user, said protective apparatus comprising a protective safety helmet for wearing on a user head and having a chin strap, and a locking buckle lockable and unlockable with an enabling key;

said sensor system comprising a plurality of physio sensors disposed within said chin strap and intended to contact said user during wearing of said helmet when said chin strap is fastened, and a tension sensor for detecting tension within said chin strap;

said sensor system generating a pin or tumbler retracting signal adapted to release said enabling key from said locking buckle only when all of said plurality of physio sensors and said tension sensor indicate that said helmet is properly secured to the head of said user; and said enabling means of said item of equipment adapted to receive said released enabling key to permit said user to render said item of equipment from said non-operational condition to said operational condition.

2. The system in claim 1, wherein: said enabling means comprises a rotational lockout system, and said enabling key is rotatable to operate said rotational lockout system.

3. The system in claim 1, wherein: said enabling means comprises a mechanical lock, and said enabling key is mechanical key rotatable within said lock to unlock said item of equipment.

4. The system in claim 1, wherein said physio sensor signal are amplified and sent though electromagnetic relays to facilitate retraction of restraining pins or tumblers in said locking buckle.

5. The system in claim 1, wherein said physio sensors are selected from the group consisting of: photoelectric pulse monitors, infrared emitting diodes and infrared receiving photo transistors, pulse monitoring sensors, and combinations thereof.

6. The system in claim 1, wherein:

said protective safety helmet is associated on a one-to-one basis with one particular item of equipment so that said item of equipment cannot be enabled into said operational state except by said particular protective helmet; and said item of equipment is selected from the group consisting of: a vehicle, a sporting good or equipment, a passageway, a tool, a snow ski, a snow board, ski boots, an ignition system, an item of equipment employing a drive motor or engine, a ride, a sled, an item of construction equipment, industrial equipment, roller blades, a snowmobile, a motorcycle, a water craft, a go cart, a forklift, a crane, a hoist, a military vehicle, an aircraft, an amusement ride, industrial equipment, a mine, a foundry, a factory, and a dangerous access area.

7. An equipment use-prevention lockout system comprising:

an item of equipment rendered in a non-operational condition until enabled to an operational condition by an enabling means;

a protective apparatus separate from said item of equipment intended to be worn by a user during operation of said item of equipment and having a sensor system for determining that said user has properly secured said protective apparatus to said user; and said sensor system communicating with said enabling means to permit said enabling means to alter the condition of said equipment from said non-operational condition to said operational condition only when said sensor system has determined that said user has properly secured said protective apparatus to said user;

said protective apparatus comprising a protective safety helmet for wearing on a user head and having a chin strap for securing said safety helmet to said user;

said sensor system comprising a plurality of physio sensors disposed within said chin strap and intended to contact said user during wearing of said helmet when said chin strap is fastened, and a tension sensor for detecting tension within said chin strap;

said sensor system generating an enable operation signal adapted to be received by a receiver associated with said item of equipment only when all of said plurality of physio sensors and said tension sensor indicate that said helmet is properly secured to the head of said user; and said enabling means of said item of equipment adapted to receive said enable operation signal to render said item of equipment from said non-operational condition to said operational condition.

8. The system in claim 7, wherein said physio sensors are selected from the group consisting of: photoelectric pulse monitors, infrared emitting diodes and infrared receiving photo transistors, pulse monitoring sensors, and combinations thereof; and said enabling signal selected from the group consisting of: an electrical signal, a magnetic signal, an audio signal, an optical signal, and an electromagnetic signal.

9. An equipment use-prevention system comprising:

equipment having a lockout system for rendering said equipment operational only when said lockout system is deactivated;

a protective apparatus separate from said equipment intended to be worn by a user during operation of said equipment and having a sensor system for determining if said user is actually wearing said protective apparatus;

said sensor system communicating with said lockout system to render said equipment operational only when said sensor system has determined that said user is actually wearing said protective apparatus;

said sensor system comprises a physio sensor disposed within said protective apparatus and intended to contact said user during wearing of said protective apparatus.

10. An equipment use-prevention system comprising:

an item of equipment rendered in a non-operational condition until enabled to an operational condition by an enabling means;

a protective apparatus separate from said item of equipment intended to be worn by a user during operation of said item of equipment and having a sensor system for determining that said user has properly secured said protective apparatus to said user;

said sensor system communicating with said enabling means to permit said enabling means to alter the condition of said equipment from said non-operational condition to said operational condition only when said sensor system has determined that said user has properly secured said protective apparatus to said user;

said protective apparatus comprises a protective safety helmet for wearing on a user head and having a chin strap, and a locking buckle lockable and unlockable with an enabling key;

said sensor system comprises a plurality of physio sensors disposed within said chin strap and intended to contact said user during wearing of said helmet when said chin strap is fastened, and a tension sensor for detecting tension within said chin strap;

said sensor system generating a pin or tumbler retracting signal adapted to release said enabling key from said locking buckle only when all of said plurality of physio sensors and said tension sensor indicate that said helmet is properly secured to the head of said user;

said enabling means of said item of equipment adapted to receive said released enabling key to permit said user to render said item of equipment from said non-operational condition to said operational condition;

said physio sensor signal are amplified and sent though electromagnetic relays to facilitate retraction of restraining pins or tumblers in said locking buckle, said physio sensors are selected from the group consisting of: photoelectric pulse monitors, infrared emitting diodes and infrared receiving photo transistors, pulse monitoring sensors, and combinations thereof;

said protective safety helmet is associated on a one-to-one basis with one particular item of equipment so that said item of equipment cannot be enabled into said operational state except by said particular protective helmet; and said item of equipment is selected from the group consisting of: a vehicle, a sporting good or equipment, a passageway, a tool, a snow ski, a snow board, ski boots, an ignition system, an item of equipment employing a drive motor or engine, a ride, a sled, an item of construction equipment, industrial equipment, roller blades, a snowmobile, a motorcycle, a water craft, a go cart, a forklift, a crane, a hoist, a military vehicle, an aircraft, an amusement ride, industrial equipment, a mine, a foundry, a factory, and a dangerous access area.

* * * * *